US007516770B2

(12) United States Patent
Jerry

(10) Patent No.: US 7,516,770 B2
(45) Date of Patent: Apr. 14, 2009

(54) ROLL-UP FLEXIBLE DOOR AND GUIDES THEREFOR

(75) Inventor: Craig John Jerry, Thornton (CA)

(73) Assignee: TNR Industrial Doors Inc. (CA)

( * ) Notice: Subject to any disclaimer, the term of this patent is extended or adjusted under 35 U.S.C. 154(b) by 766 days.

(21) Appl. No.: 10/813,711

(22) Filed: Mar. 31, 2004

(65) Prior Publication Data

US 2005/0005545 A1 Jan. 13, 2005

Related U.S. Application Data

(60) Provisional application No. 60/485,721, filed on Jul. 10, 2003.

(30) Foreign Application Priority Data

Oct. 24, 2003 (CA) ..... 2446648

(51) Int. Cl.
*E06B 9/56* (2006.01)

(52) U.S. Cl. ..... 160/267.1; 160/273.1; 160/272; 160/84.06

(58) Field of Classification Search ..... 160/273.1, 160/271, 272, 133, 310, 84.06; 70/99, 100
See application file for complete search history.

(56) References Cited

U.S. PATENT DOCUMENTS 797,652 A 8/1905 Wilson et al.
1,791,548 A 2/1931 Zucca
4,467,853 A * 8/1984 Downey, Jr. ..... 160/133
4,601,320 A 7/1986 Taylor
5,058,651 A 10/1991 Ashley et al.
5,176,194 A 1/1993 Chigusa
5,368,084 A 11/1994 Hying et al.
5,381,846 A 1/1995 Lichy
5,392,836 A 2/1995 West et al.
5,482,104 A * 1/1996 Lichy ..... 160/273.1
5,579,820 A 12/1996 LePage et al.
5,682,937 A 11/1997 Decrane et al.
5,747,738 A * 5/1998 Indoe ..... 174/66
5,839,493 A 11/1998 Quasius
5,964,270 A 10/1999 Kirkey et al.
6,059,007 A 5/2000 Tomita
6,065,525 A * 5/2000 Wells ..... 160/273.1

(Continued)

FOREIGN PATENT DOCUMENTS

GB 2137271 A 10/1984

*Primary Examiner*—Katherine Mitchell
*Assistant Examiner*—Candace L. Bradford
(74) *Attorney, Agent, or Firm*—Bliss McGlynn, P.C.

(57) ABSTRACT

A roll-up door assembly including a flexible curtain made of synthetic rubber or fabric, a curtain winding mechanism and two guide members which extend vertically on opposite sides of the doorway. Side edge sections of the curtain are movable in respective guide members. Each guide has inner and outer wall sections with each wall section having an inwardly projecting, longitudinal rib. The two ribs of each guide form an elongate slot that receives a side edge section of the curtain. Spaced-apart pairs of curtain lock members are mounted on and distributed along each side edge section of the curtain. The lock members of each pair are positioned opposite one another on front and rear surfaces of the curtain respectively. The combined thickness of each pair of lock members and the curtain exceeds the width of the elongate slot.

17 Claims, 7 Drawing Sheets

U.S. PATENT DOCUMENTS 6,068,040 A * 5/2000 Magro et al. ..... 160/133
6,152,208 A * 11/2000 Kalempa et al. ..... 160/273.1
6,397,921 B1 6/2002 Wartenbergh
6,449,916 B1 * 9/2002 Waters ..... 52/455
7,131,481 B2 * 11/2006 Varley et al. ..... 160/273.1

* cited by examiner

ROLL-UP FLEXIBLE DOOR AND GUIDES THEREFOR

PRIOR APPLICATION

This application claims priority on the basis of previously filed U.S. Provisional Patent Application No. 60/485,721 filed Jul. 10, 2003.

BACKGROUND OF THE INVENTION

This invention relates to roll-up type door assemblies which are generally used in commercial and industrial applications, elongate guides for use in these door assemblies, and curtain locks for retaining edge sections of the flexible door curtains used in these door assemblies.

It is well known in the door industry to provide a flexible, roll-up door that can be used to provide a passageway barrier in industrial, commercial, mining and other such facilities to accommodate the access of trucks, trains, forklifts and other such equipment to the facility or building or to provide passageway barriers within the facility or building.

A flexible roll-up door typically consists of a synthetic rubber or fabric curtain which acts as a barrier across the passageway. The curtain is attached across its top edge to a rigid steel pipe spanning the width of the passageway. This steel pipe is typically known as a drive barrel and is equipped with a solid steel shaft at both ends. Each of the two steel shafts are supported by a flanged type bearing attached to a steel plate, typically known as an endplate, which is attached to the, building structure directly above the passageway. Applying a controlled rotational movement of the drive barrel results in the curtain spooling onto the drive barrel, thus retracting the curtain upward to expose the passageway. Also, it may be inversely spooled off the drive barrel to dispense the curtain downward and close off the passageway.

The lower, horizontal perimeter or bottom of the curtain is reinforced with structural steel members to provide rigidity to the section of curtain edge making contact with the ground. This component of a flexible roll-up door is typically known as a bottom bar and must be of sufficient rigidity to maintain adequate straightness of the curtain for the operation of the door. The bottom bar is configured to a predetermined mass to provide adequate gravitational force to pull the curtain to the ground. The bottom bar may include reversing, safety and/or sealing devices mounted thereon.

The two vertical perimeters or edge sections of the curtain usually travel within suitable enclosures mounted adjacent to the passageway on each side. This component is typically known as a guide and serves the purpose of maintaining the required position of the vertical edge of the curtain while permitting unrestricted travel during door operation. The curtain is most often configured along its vertical edges with appropriate components, hereto referred to as curtain locks, to mate with the guides. Many flexible roll-up doors are constructed so that a predetermined releasing force can-cause the curtain to disengage itself from the guide or guides, for example, when the curtain is impacted by a vehicle or other device. The curtain is both retracted by and dispensed from the drive barrel over the forward side of a horizontal, rigid steel pipe spanning the width of the passageway. This pipe is located above the passageway and in close proximity to the building structure to provide an upper horizontal perimeter seal to the passageway and further serves as a curtain positioning mechanism, aligning the curtain with the guides mounted to the vertical sides of the passageway. This steel pipe is typically known as an idler barrel and is equipped with a solid steel shaft at both ends. Each of the two steel shafts are supported by a flange type bearing attached to its respective mounting angle.

The known flexible roll-up door systems can also include various other components to complete their functionality such as a counterbalance system, often through the use of torsion springs and/or weights, an operating mechanism that may consist of a manual hoist and/or electric motor with gear and/or chain power transmission arrangement, along with other secondary components. Known roll-up doors are commonly equipped with a curtain that has an element or elements attached to the vertical edges of the curtain (forming a curtain lock or locks) that co-operate with fabricated, often elaborate, guide assemblies.

U.S. Pat. No. 5,392,836 which issued Feb. 28, 1995 to Rite Hite Corporation teaches the use of a series of hemispherical follower elements attached to side edge sections of the curtain of a roll-up type door. An external force can disengage these follower elements from the door guide by changing the relative dimension of the gap formed by the guide and the follower element or elements. This relative dimensional change is achieved by utilizing a multiple component, fabricated guide that is inherently incapable of precise production dimensioning and often becomes askew or out of alignment during service. Thus, it is believed that this known roll-up door system is incapable of precise operation and therefore lacks reliability.

U.S. Pat. No. 5,482,104 issued Jan. 9, 1996 to Dale Lichy also describes a multi-component guide assembly which an external force, such as an impact from a vehicle, can disassemble to provide disengagement of an edge section of the curtain from its respective guide assembly. In one embodiment, each side edge of the curtain is provided with a lock strip which is bonded to one surface of the side edge. The strip is relatively narrow in width and has a thickness about the same as that of the curtain. In a second version of the curtain, there is a lock strip on the outer surface of the curtain edge and a further lock strip on the inner surface so that the strips form double wind locks. The two strips are not aligned with each other with the strip on the outer surface being spaced laterally inwardly from the edge of the curtain and the other strip having its outer edge generally aligned with the side edge of the curtain.

It is an object of one aspect of the present invention to provide a novel roll-up type door assembly having a flexible curtain made of rubber, synthetic rubber or fabric material employing extruded guide members that are relatively easy to manufacture and install and that can be made at a reasonable cost and employing pairs of curtain lock members mounted on the side edge sections of the curtain which help hold the side edge sections of the curtain in the guide members.

It is an object of another aspect of the present invention to provide an elongate guide for use with a roll-up type door which can be manufactured relatively easily using known manufacturing techniques and at a reasonable cost and which is capable of engaging a curtain lock mechanism with interior concave surfaces in a manner so that the guide is capable of engaging the lock mechanism on both front and back sides of the curtain simultaneously.

It is an object of an additional aspect of this invention to provide an improved and novel door curtain lock for retaining an edge section of a flexible door curtain in a door guide, this lock being made of low friction, wear resistant plastics material and having a rounded exterior surface and an inner surface for mounting to a front or rear surface of the door curtain.

SUMMARY OF THE INVENTION

According to one aspect of the invention, a roll-up type door assembly includes a flexible curtain made of rubber, synthetic rubber or fabric material and capable of closing a doorway, this curtain having upper and lower ends and two opposite side edges. There is also a curtain winding mechanism having the upper end of the curtain attached thereto for raising the curtain by rolling the curtain up. The assembly also has two straight, extruded guide members which are made of flexible metal and, during use of the door assembly, are mounted so as to extend vertically on opposite, vertical sides of the doorway. Side edge sections of the curtain are each movable in a respective one of the guide members when the curtain is raised or lowered during use thereof. Each guide member is formed with integrally connected, inner and outer, longitudinally extending wall sections. Each wall section has an inwardly projecting, longitudinally extending rib with the two ribs of each guide member forming an elongate slot through which a respective one of the side edge sections can extend during use of the door assembly. Spaced-apart pairs of curtain lock members are mounted on and distributed along each side edge section of the curtain. The lock members of each pair are positioned opposite one another on front and rear surfaces of the curtain respectively. The combined thickness of each pair of lock members and the curtain material exceeds the width of the elongate slot so that the pairs of lock members prevent the side edge sections of the curtain from escaping out of the guide members under normal wind load or pressure conditions. At least some curtain lock members engage with the ribs of the respective guide members when an excessive wind load or impact is put upon the curtain and this engagement causes the arm sections of at least one guide member to separate from each other and thereby release the respective side edge section from the at least one guide member with little, if any, damage to the curtain or the guide members.

Preferably, each curtain lock member is made of low friction, wear resistant plastics material and has an elongate main body section having a rounded exterior surface as seen from an end of the lock member. This lock member is mounted on its side edge section of the curtain so that its longitudinal axis is substantially parallel to the adjacent side edge of the curtain.

According to another aspect of the invention, an elongate guide for use with a roll-up type door equipped with curtain lock mechanisms arranged along two opposite side edge sections of a flexible curtain for the door includes an elongate, metal guide member having inner and outer, longitudinally extending, substantially planar wall sections with a cavity formed between these wall sections. This cavity is adapted to slidably receive one of the side edge sections. The guide member also has a base section integrally connected to and joining the inner and outer wall sections and two, longitudinally extending metal ribs each integrally formed on a respective one of the inner and outer wall sections and together defining one end of the cavity as seen in transverse cross-section. The two ribs project inwardly towards each other and form an elongate slot which is substantially narrower than the maximum width of the cavity as measured between the two wall sections and through which a respective one of the side edge sections can extend during use of the guide. Each rib has an elongate interior surface which is concave as seen in transverse cross-section and the concave surfaces of the two ribs form an elongate split curved socket for directly engaging the curtain lock mechanism when the lock mechanism is located in the guide during use thereof. The split curved socket is capable of engaging the lock mechanism on both front and back sides of the curtain simultaneously.

The preferred guide member is an integral, one-piece metal extrusion and the preferred metal is aluminum alloy.

According to another aspect of the invention, a door curtain lock for retaining an edge section of a flexible door curtain in an elongate door guide mounted on a side of a doorway includes a lock member made of low friction, wear resistant plastics material. This lock member has an elongate, rigid main body section having exterior surface which is rounded as viewed from one end of the lock member. The rounded exterior surface extends to at least one longitudinal side of the main body section. The lock member also has an inner surface adapted for mounting to a front or rear surface of the door curtain. Also, at least one hole for a mechanical fastener is found in the main body section.

Preferably the lock member has a substantially flat wing section integrally connected to one longitudinal side of the main body section and adapted to extend through an elongate slot formed in the door guide during use of the curtain lock. This wing section projects outwardly from an inner edge of the main body section.

According to yet another aspect of the invention, a door curtain for use in a roll-up door apparatus comprises a flexible curtain made of rubber, synthetic rubber or fabric and capable of closing a doorway. The curtain has front and rear surfaces, upper and lower ends and two opposite side edges. Strips of low friction, wear-resistant material are affixed to at least one of the front and rear surfaces adjacent the opposite side edges, the wear-resistant material selected from the group consisting of oliphatic polyetherurethane in dichlormethane (OPD) and polyethylene terepthalate (PET) polyester with a polyvinylchloride (PVC) backing. A plurality of curtain lock members are mounted on and distributed along the strips of wear-resistant material, these lock members being spaced apart from one another.

Further features and advantages will become apparent from the following detailed description taken in conjunction with the accompanying drawings.

DETAILED DESCRIPTION OF PREFERRED EMBODIMENTS

Figure 1:
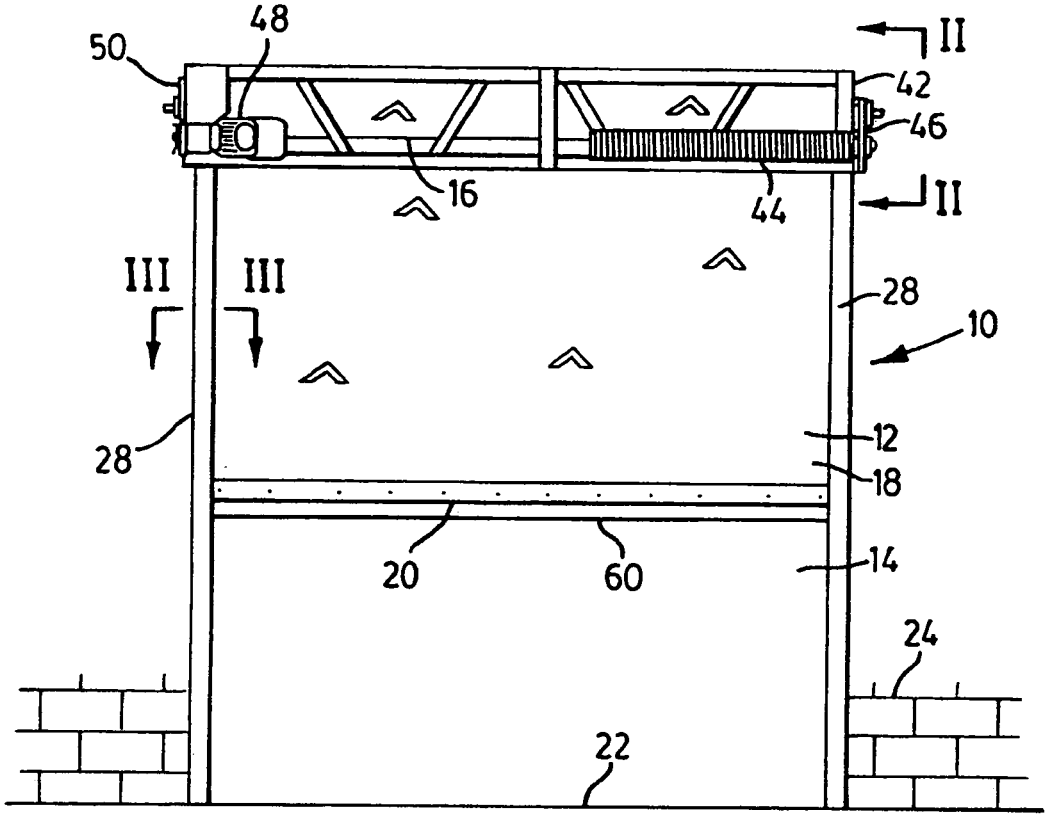
FIG. 1 is an elevational view of a flexible, roll-up door constructed in accordance with the invention.
Figure 2:
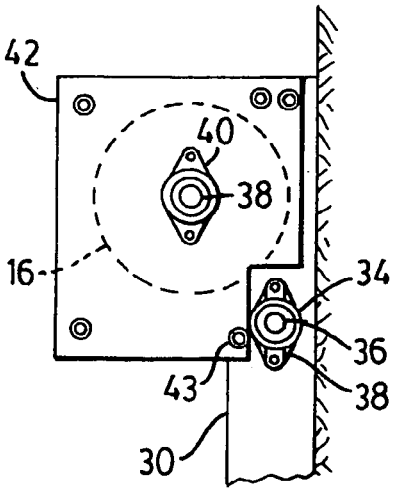
FIG. 2 is a detail end view on a scale approximately three times the scale of FIG. 1, this view being taken along the line II-II of FIG. 1 and illustrating the relative position and attachment of some door components positioned at the top of the door opening.
Figure 3:
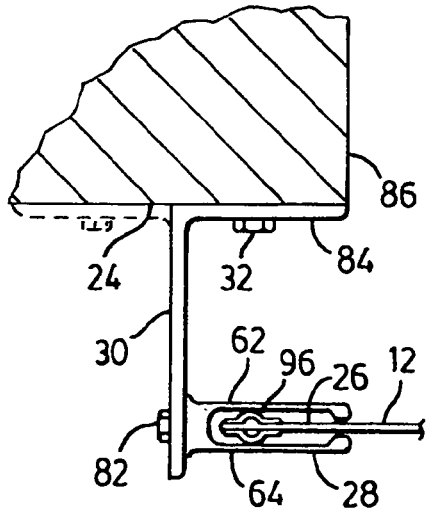
FIG. 3 is a cross-sectional detail view along section line III-III of FIG. 1 illustrating the relative positioning and attachment method of a door guide, a mounting angle for the guide and a door edge section.
Figure 9:
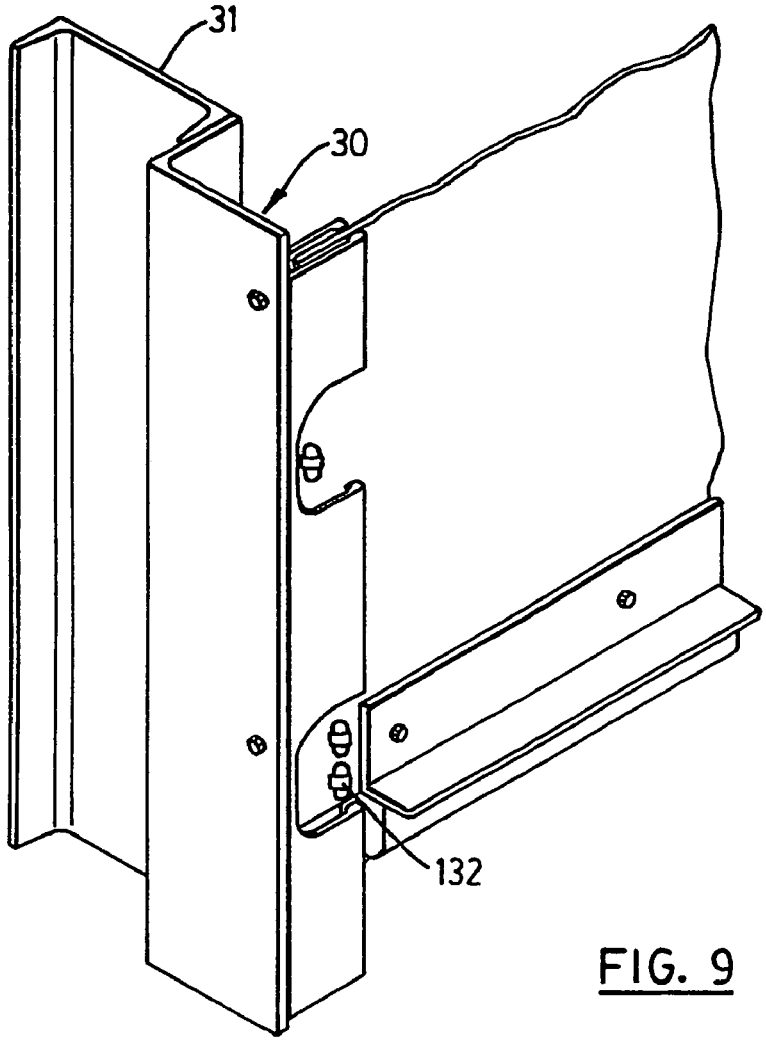
FIG. 9 is an isometric view illustrating one lower corner of the door curtain together with a section of a door guide and adjacent mounting angle, this view illustrating their assembled relationship.
Figure 10:
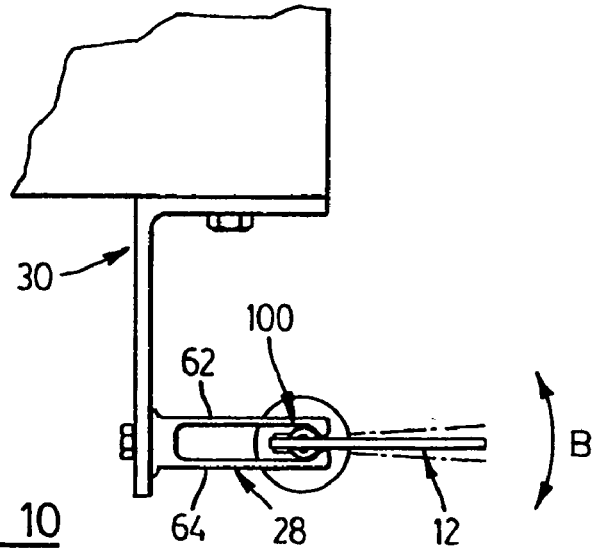
FIG. 10 is a cross-sectional detail similar to FIG. 3, this view illustrating the functional cooperation between the door guide, the cooperating edge section of the curtain and curtain locks mounted on the curtain, these components being subjected to normal external force bias.

FIGS. 1 to 3 illustrate a preferred roll-up type door assembly 10 constructed in accordance with the invention and installed in the doorway of a building or other structure. The assembly 10 includes a flexible curtain 12 made of rubber, synthetic rubber or fabric material and capable of closing a doorway 14. It will be understood that the curtain has an upper end mechanically fastened to a drive barrel 16 and also a lower end 18 mechanically fastened to a rigid bottom bar 20. The curtain 12 is dimensioned to fit and completely cover the doorway 14 when the bottom bar is lowered to the ground or floor at 22. The doorway 14 is formed in a wall 24, only a portion of which is shown for ease of illustration. The upper end of the curtain, which extends horizontally during use of the curtain, can be wound up or lowered by the barrel 16 which is part of a curtain winding mechanism. Vertical side edge sections 26 of the curtain are movably mounted in two straight, extruded guide members 28 which are made of flexible metal, preferably aluminum alloy. When the door assembly is installed in the doorway, the two guide members extend along the two vertical sides of the doorway 14 and they are each mechanically fastened to a mounting angle 30. The cross-section of a preferred form of mounting angle can be seen clearly in FIG. 3 and it will be understood that this mounting angle can extend the full height of the doorway 14. The mounting angle is secured in an appropriate manner to the wall 24 of the structure. This wall can include a vertical steel channel 31 as shown in FIG. 9. The wall 24 can also be made of concrete or concrete blocks as shown in FIGS. 1,3 and 10 and the mounting angle 30 attached to the concrete surface. By way of example, the mounting angle on each side can be secured to the wall by fasteners 32, such as bolts, distributed along its length. Although the illustrated mounting angle 30 is preferred, it will be understood that other forms of frame means for mounting the guide members 28 on the vertical sides of the doorway can also be used. The mounting angle 30 can be made of structural steel.

An idler barrel 34 can be located above the top of the doorway 14 and is secured by its solid steel end shafts 36 to the mounting angle 30 by means of flange type bearings 38 mechanically secured to the mounting flange. Also, in a known manner, each of the two ends of the drive barrel 16 is supported by a solid steel shaft 38 mounted in and supported by flange type bearings 40. The bearings 40 are mounted by suitable fasteners to respective end plates 42. Each end plate 42 is mechanically fastened by suitable fasteners, such as bolts 43, to the adjacent mounting angle 30. The illustrated roll-up type door is counter-balanced by use of a torsion spring 44 utilizing a chain drive 46 which is connected to the drive barrel 16. The use of a torsion spring in this manner is well known in the roll-up door industry and accordingly a detailed description herein is deemed unnecessary. It is also possible to utilize various known substitutes in lieu of the torsion spring 44. The roll-up door can be powered by an electric motor and gear box operator 48 which uses a chain drive 50 that is also connected to the drive barrel 16. Again, a power drive of this type is well known in the roll-up door industry.

Figure 5:
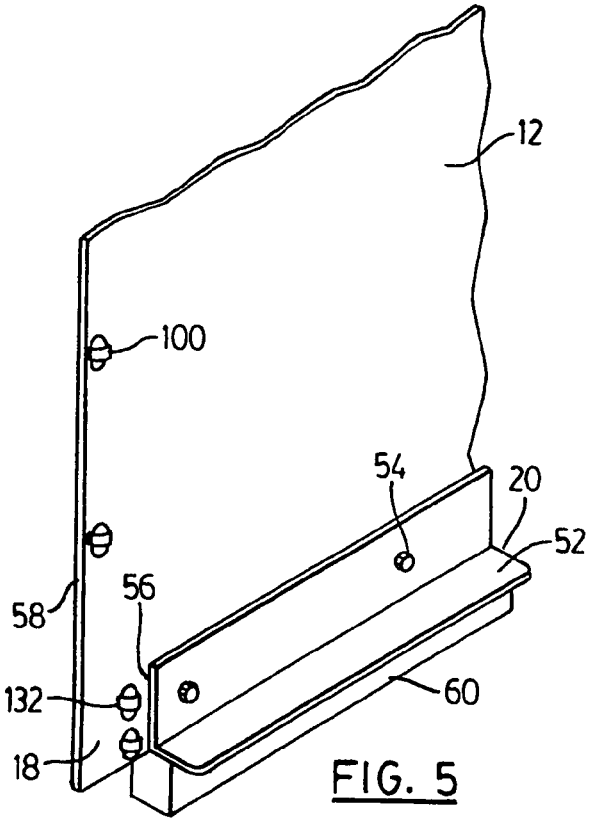
FIG. 5 is an isometric illustration of one lower corner of the curtain, this view showing the bottom bar and some curtain locks.

Referring to FIG. 5, this figure shows a bottom corner of the door curtain 12 with the bottom bar 20 attached thereto. The bottom bar typically comprises a couple of steel angle members 52 mounted on opposite sides of the lower end 18 of the curtain. The bottom bar can be secured to the curtain using bolts 54. It will also be noted that each end 56 of the bottom bar is spaced away from the adjacent side edge 58 of the curtain. Thus, the bottom bar does not extend into the metal guide member 28 but only extends between the two guide members. However, if desired, plastic arms (not shown) can be fastened to the ends of the bottom bar so as to extend into the guide members. Mounted on the bottom of the bar can be a known form of safety strip device 60 that can, for example, cause the door to stop or retract upwardly if the safety strip device strikes an object such as a vehicle or person. The strip device 60 can also serve as a bottom seal.

As indicated, the two vertical side edge sections of the curtain are each movable in a respective one of the guide members 28 when the curtain is raised or lowered during use thereof. Each guide member is formed with integrally connected, inner and outer, longitudinally extending wall sections 62 and 64. Each of these wall sections is generally planar and each has an inwardly projecting, longitudinally extending rib 66. The two ribs 66 of each guide member form an elongate slot 68 through which a respective one of the side edge sections of the curtain can extend during use of the door assembly, as shown in FIG. 3. A cavity 70 is formed between the wall sections 62, 64 and is adapted to slidably receive this side edge section of the curtain. A base section 72 is integrally connected to and joins the inner and outer wall sections of the guide member. The base section forms a substantially flat end wall 74 suitable for mounting the guide member on the mounting angle 30. The illustrated guide member has corner projections 76 with each projecting beyond the outer surface of the adjacent wall section and helping to support the guide member in the required perpendicular position in which it is mounted on the mounting angle. A centering groove 78 can also be provided, if desired, midway between the corner projections and this groove can be used to properly locate a series of spaced apart threaded holes 80 that are used to mount the guide member on the mounting angle. A number of bolts 82 extend through holes in the mounting angle and can be threaded into the holes 80 to secure the guide member. If desired, the leg 84 of the mounting angle 30 (see FIG. 3) that is fastened to the wall 24 can be reversed as indicated by the dash lines, thus moving the fastening point for the mounting angle further away from the vertical edge 86 of the door opening. This alternative position is available to the door installer on the site where the door system is being installed and it may allow him or her the option of selecting a possibly more stable or stronger building material for fastening the mounting angle and its guide. This mounting arrangement is typically not available for other door guides now in use for flexible doors.

The slot 68 formed by the two ribs is substantially narrower than the maximum width W of the cavity as measured between the two wall sections. The illustrated preferred cavity 70 is of substantial uniform width W, although internal corners at 90 are preferably rounded. The rounded corners or inner radii 90 have a radius that is chosen for both desired elastic properties and structural integrity of the respective wall sections that are connected at these corners. Preferably the horizontal length of the cavity 70, that is the distance measured between the base and the slot 68 is substantially greater than the width W of the cavity in order to properly accommodate the side edge section of the curtain. In the guide shown in FIG. 4, each rib 66 has an interior surface 94 which is elongate and concave, as seen in transverse cross-section (see FIG. 4). The concave surfaces 94 of the two ribs form an elongate split, curved socket for directly engaging the curtain lock mechanism when the lock mechanism is located in the guide during use thereof. Two forms of this curtain lock mechanism are described in detail below. The split curved socket is capable of engaging the lock mechanism indicated generally at 96 in FIG. 3 on both front and back sides of the curtain 12 simultaneously.

The preferred guide member is an integral, one piece metal extrusion which can be manufactured at a reasonable cost. The preferred guide members are made of aluminum alloy that has been appropriately heat treated to provide mechanical properties that are advantageous for the function and operation of the guide member (explained more fully below). One desirable property of the guide member is its ability to reinstate and maintain its precise geometric characteristics and dimensions after deformation from induced stresses. A particularly preferred version of each guide member is made out of 6061 T6 aluminum alloy, an alloy having the desired properties.

Figure 4:
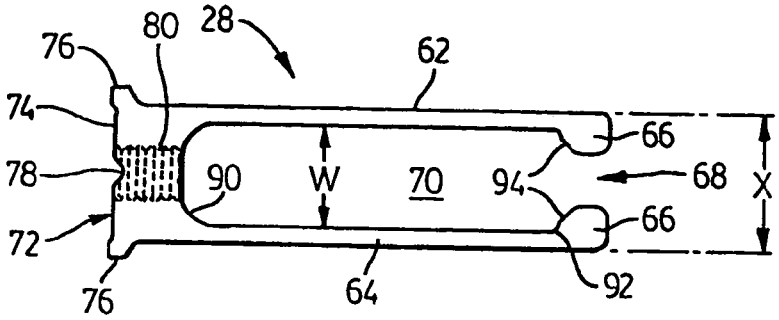
FIG. 4 is an enlarged end view of one door guide, this figure being on a scale about three times that of FIG. 3.
Figure 14:
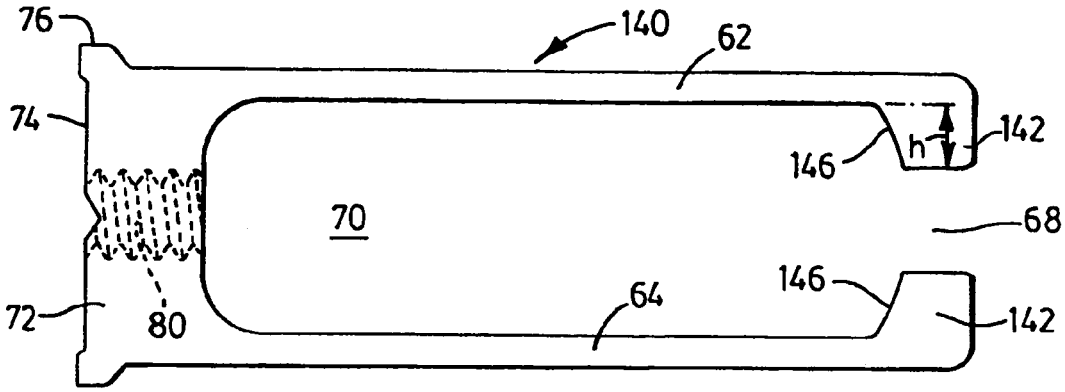
FIG. 14 is an enlarged end view of a preferred door guide.

The width of the narrow access slot 68 formed by the ribs is significant and in one version of the guide member, this width is $7/16^{th}$ inch in the relaxed, normal state of the guide member and in another preferred version this width is ½ inch. Preferably the guide member also has a horizontal length, as seen in FIGS. 4 and 14, of four inches and an external width X (including the cavity 70 and the two wall sections) of 1¼ inch. This particular guide member has an internal cavity width W of one inch. It will be understood that the inner and outer walls sections 62, 64 are extruded so as to have an appropriate thickness to provide both the desired elastic properties and structural integrity for the guide member to perform its function as explained more fully below. The wall sections 62, 64 are preferably equal in width in the direction extending from the base section of the guide towards the slot 68 and the two ribs are preferably integrally formed on the free inner edges of their respective wall sections (relative to the doorway 14).

A preferred form of one piece guide member 140 is illustrated in FIG. 14. Except as indicted hereinafter, this guide member and its preferred dimensions are substantially the same as indicated for the guide member 28 of FIG. 4. The guide member 140 also has integrally connected, inner and outer, longitudinally extending wall sections 62 and 64. Each of these wall sections has an inwardly projecting, longitudinally extending rib 142 and these ribs form the elongate slot 68 through which a respective one of the side edge sections of the curtain can extend during use of the door assembly.

Figure 18:
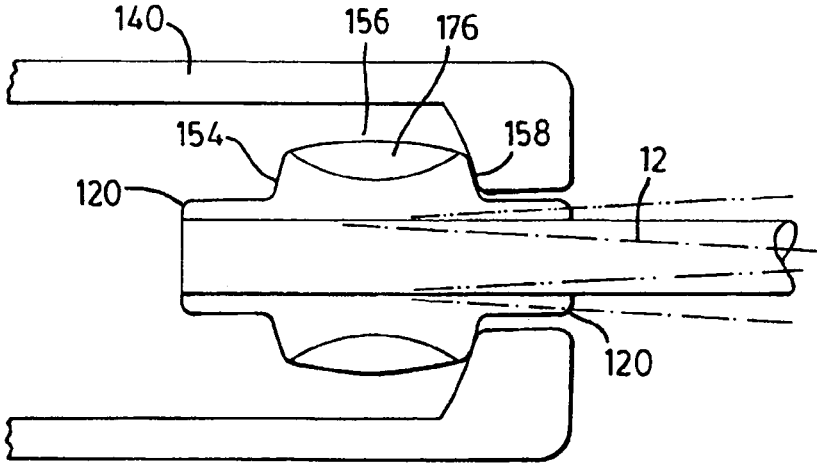
FIG. 18 is a detail view similar to FIG. 11 showing the cooperation between the guide and a pair of the lock members of FIG. 15 to 17.

The major difference between the guide member 28 and the guide member 140 is the shape and the construction of the two ribs. In the guide member 140, each rib 142 has an interior surface 146 which is elongate and concave as seen in the transverse cross-section of FIG. 14. In this preferred embodiment, the concave surfaces 146 extend substantially the height of each rib, this height h being indicated in FIG. 14. The concave surfaces 146 again form an elongate, split, curved socket for directly engaging the curtain lock mechanism when the lock mechanism is located in the guide. This split curved socket is capable of engaging the lock mechanism as illustrated in FIG. 18 on both front and back sides of the curtain 12 simultaneously.

Figure 7:
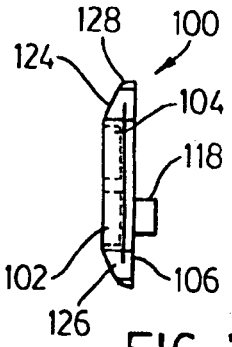
FIG. 7 is a side view of the curtain lock member of FIG. 6, this view being taken from the right side of FIG. 6.
Figure 8:
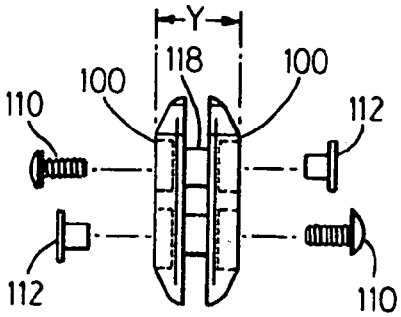
FIG. 8 is a side detail similar to FIG. 7 but showing two curtain lock members in position for attachment and illustrating two threaded fasteners for securing same.

Preferably the lock mechanism for each side edge section of the door curtain comprises spaced-apart pairs of curtain lock members mounted on and distributed along each side edge section of the curtain. One version of individual lock member 100 is illustrated by itself in each of FIGS. 6 and 7 while a combined pair of these curtain lock members is illustrated in FIG. 8. It will be understood that the lock members of each pair are preferably positioned directly opposite one another on front and rear surfaces of the curtain 12 as can be seen in FIGS. 3 and 10 to 13. Because of the manner in which the lock members 100 are mounted on the curtain, the combined thickness indicated at Y in FIG. 11 of each pair of lock members and the curtain material exceeds the width of the elongate slot 68 so that the pairs of lock members 100 prevent the side edge sections of the curtain 12 from escaping out of the guide members 28 under normal windload or pressure conditions. It will be understood that at least some, if not the majority, of the curtain lock members 100 engage with the ribs 66 of their respective guide members when an excessive windload or impact is put upon the curtain 12 and this engagement causes the wall sections of at least one guide member to separate from each other and thereby release the respective side edge section (or part thereof) from the guide member with little, if any, damage to the curtain or the guide members.

Figure 6:
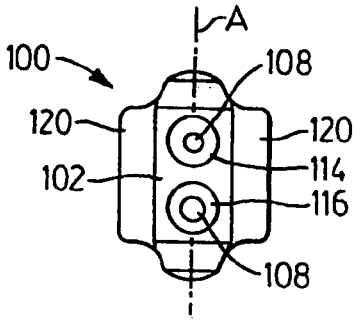
FIG. 6 is an enlarged detail view of the outer side of one curtain lock member.

Three versions of the lock member will be described in detail but it will be understood that other lock member constructions are also possible and can be used in combination with the illustrated and described guide members. Each curtain lock member is made of a low friction, wear resistant plastics material. One preferred material for each curtain lock member is Kocetal-polyoxymethylene (POM) which is a copolymer-type polyacetal resin manufactured by Kolon Industries, Inc. and Toray Industries Inc. The lock member 100 of FIG. 8 has an elongate, main body section 102 having a rounded exterior surface 104 as seen from one end or either end of the respective lock member. The lock member is mounted on its side edge section of the curtain so that its longitudinal axis indicated at A in FIG. 6 is substantially parallel to the adjacent side edge 58 of the curtain. The rounded exterior surface 104 extends to at least one longitudinal side of the main body section and, in the illustrated embodiment, extends to both longitudinal sides of the main body section. The lock member 100 also has an inner surface 106 which is adapted for mounting to a front or rear surface of the curtain. Also, there is at least one hole, and preferably two holes 108, for a mechanical fastener or fasteners formed in the main body section.

With reference to FIG. 8, there can be seen an assembled pair of curtain lock members 100 which are geometrically symmetrical when mechanically attached in an inverted fashion using two machine screws 110 to extend through the two holes 108. Preferably, the screws are threaded into matching binder posts 112 which are internally threaded and can be made of a suitably strong metal. Both the machine -screws and the binder posts are concealed within counter bores 114, 116 formed in the lock members. The joined pair of curtain lock members 100 have the aforementioned combined width Y when mounted on the curtain. In this embodiment, each lock member is formed with an integral protrusion 118. Although the dimension Y can vary and depends on such factors as the thickness of the curtain 12, in one preferred curtain the dimension Y measures ¾ inch and it is used with a guide member having a slot width of $7/16^{th}$ inch or preferably ½ inch. The length of each protrusion 118 in this first embodiment is made or adjusted so that it corresponds closely to the thickness of the curtain with which the lock member will be used. It will be understood that a pair of holes is formed in the side edge section of the curtain for each pair of lock members to accommodate the fastening of same. It should be noted that the dimension Y is selected so that the curtain edge sections can travel freely within their respective guide members 28 during normal use and operation of the door with the lock members experiencing only casual contact with the inside of their respective guide member. This slightly loose fit of each pair of lock members in their respective guide member is visible in FIG. 11.

Preferably, each lock member is also formed with at least one substantially flat wing section 120 integrally connected to a longitudinal side of the main body section 102. In the illustrated lock member 100 there are two of these wing sections 120, each extending from its respective longitudinal side of the main body section. At least one of these wing sections is adapted to extend through or into the elongate slot 68 formed in the respective door guide during use of the curtain lock. This passage of the wing section through the slot can be seen in FIG. 11. Each wing section 120 projects outwardly from an inner edge 122 of the main body section. As illustrated, the length of the wing section is sufficient to project completely through the slot when the lock members are in the position shown in FIG. 11, that is, when the curtain is experiencing normal stress conditions. The lock member 100 has two opposite end sections 124, 126 which taper longitudinally outwardly and in the direction of the inner surface of the lock member. This further facilitates the easy sliding movement of the lock member in the door guide. Each end section 124,126 can be formed with a rounded end at 128.

Figure 15:
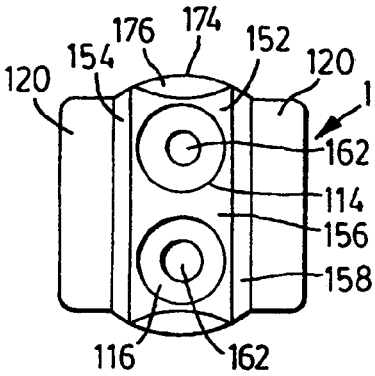
FIG. 15 is an enlarged detail front view of another form of curtain lock member.
Figure 16:
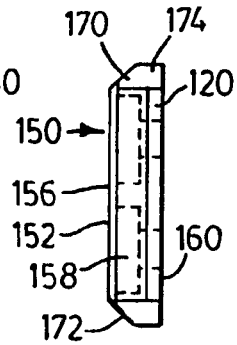
FIG. 16 is a side view of the lock member of FIG. 15, this view being taken from the right side of FIG. 15.
Figure 17:
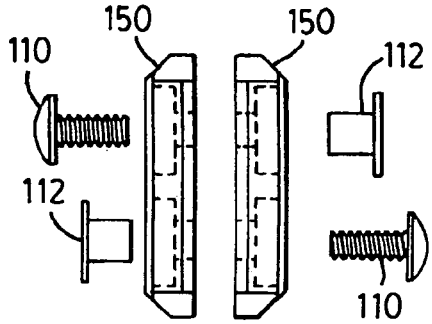
FIG. 17 is a side detail view showing two of the lock members of FIG. 15 in position for attachment and illustrating the fasteners to be used.

A second form of lock member 150 is illustrated by itself in FIGS. 15 and 16, while FIG. 17 illustrates how a pair of these curtain lock members are arranged for attachment to opposite sides of a curtain (not shown). Except for the differences noted hereinafter, it will be understood that the lock member 150 is substantially the same in its construction to the lock member 100 shown in FIGS. 6 and 7. The lock member 150 has an elongate, main body section 152 having three curved or rounded, longitudinally extending surfaces at 154,156 and 158. As with the first embodiment, the lock member 150 is mounted so that its longitudinal axis is substantially parallel to the adjacent side edge 58 of the curtain. Each of the curved surfaces 154, 158 forms a longitudinal side of the main body section. The lock member also has an inner surface 160 which is substantially flat and thus is adapted for mounting to a front or rear surface of the curtain. Unlike the lock member 100, the lock member 150 has no protrusion 118 projecting from the inner surface. As in the first embodiment, a pair of the lock members 150 can be mechanically attached to opposite sides of the curtain by means of two machine screws 110 that extend through two holes 162. Counterbores 114, 116 are also formed in the lock member 150. This embodiment also has a pair of flat wing sections 120 integrally connected to the main body section and extending from opposite sides thereof.

A further difference in the construction of the two lock members is the shape of the opposite end sections formed on each lock member. The lock member 150 has opposite end sections 170, 172 and these are substantially shorter than the end sections 124, 126 of the lock member 100. Each end section is formed with a rounded end wall 174 and a sloping side 176. Thus, the end sections 170, 172 also taper longitudinally outwardly and in the direction of the inner surface of the lock member. The shape of the end sections 170, 172 also facilitates the easy sliding movement of the lock member in the door guide.

In the preferred case where the wing sections are provided on the lock members, the combined thickness T of two wing sections of the pair of lock members and the curtain material should be less than the width of the elongate slot 68 in the normal, relaxed state of the guide. This thickness T is indicated in FIG. 11.

With reference again to FIG. 5, this figure illustrates how the pairs of lock members 100 are longitudinally spaced along the vertical edges of-the curtain and they are preferably in close proximity to the curtain edge 58. Most of the lock pairs along each edge can be vertically aligned as shown. However, in the illustrated curtain of FIG. 5, near the bottom edge of the curtain, there can be one or two sets of curtain lock pairs 132. As illustrated in FIG. 5 and 9, there are two of these pairs 132 at each end of the bottom bar 20. If desired, these lock pairs 132 can be slightly offset from the vertical axis formed by the vertical alignment of the lock pairs located above the bottom bar. Although the lock pairs 132 are still located within the respective guide members 28, because of the offset, they cooperate with the bottom bar 20 to provide lateral stability to the lower portion of the curtain and the bottom bar.

Figure 11:
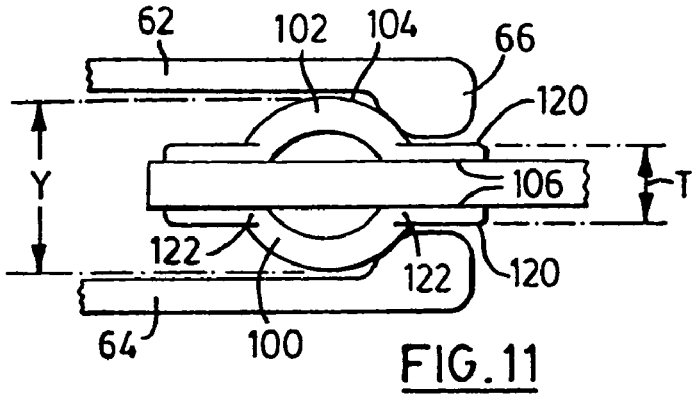
FIG. 11 is a detailed view of the circled area in FIG. 10 showing the cooperation between the guide and a pair of curtain lock members on an enlarged scale.

FIGS. 10 and 11 illustrate the functional relationship between one of the guide members 28, the curtain 12 and a pair of curtain lock members 100 during normal external force bias such as normal windloading on the curtain 12. The curved, two directional arrow B, is indicative of the normal dynamic force that acts on the central area of the curtain to cause a bellowing action. This action draws the pairs of curtain locks 100 into the split socket receptacle of the guide members 28. Because of the exterior curvature of the lock members and the concave interior surfaces 94 formed on the ribs, the lock members 100 can pivot in a "ball joint" fashion to accommodate the dynamic fluctuations and the changes in the position of the curtain 12. This ball joint action is enhanced by matching the external curvature of each lock member 100 to the concave curvature of the elongate interior surfaces 94. Note that by the provision of the wing sections that extend into the slot of the guide, these wing sections being made of low friction material, even though the lock members are in the position shown in FIG. 11, the curtain is still able to readily move upwardly or downwardly in its guide members because of the low friction at the contacting surfaces within the access slot 68.

Figure 12:
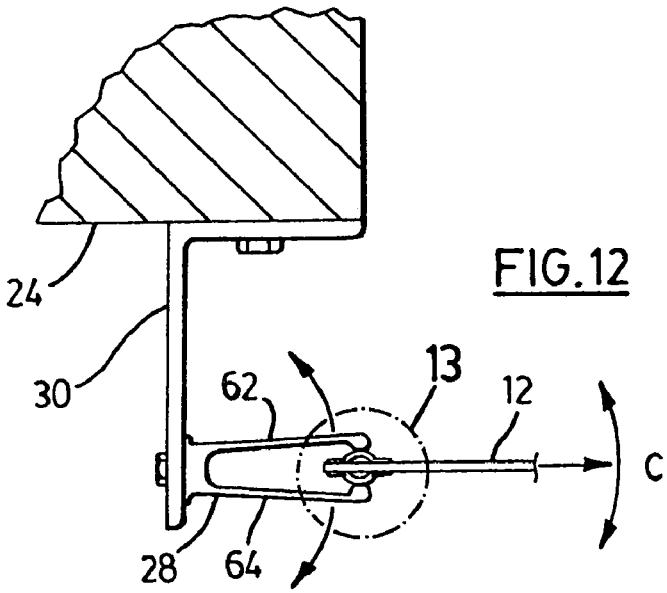
FIG. 12 is a cross-sectional detail view similar to FIGS. 3 and 10 illustrating the functional cooperation between the door guide, the curtain and curtain lock members under extreme external force conditions which cause the edge section of the curtain to be pulled out of the guide.
Figure 13:
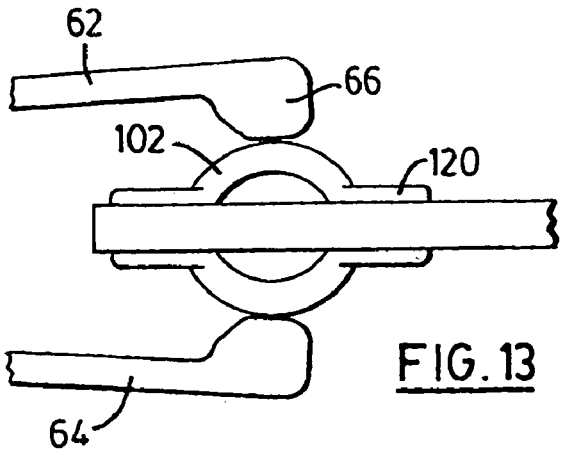
FIG. 13 is a detail view of the circled area of FIG. 12 showing the cooperation between the side walls of the guide and the curtain lock members under extreme external force conditions.

FIGS. 12 and 13 are cross-sectional details illustrating what occurs amongst the door guide, the curtain 12 and the curtain locks when an extreme dynamic force, such as that caused by vehicular impact on the curtain, is pulling on the curtain. This extreme force or bias pulls not only inwardly on each curtain edge section but also pulls the central area of the curtain either inwardly or outwardly of the door opening as indicated by the curved double pointed arrow C. This extreme force on the curtain and its edge section is evenly distributed to the symmetrical wall sections 62, 64 and their respective ribs 66 due to the symmetrical "ball joint" connection formed where the lock members engage the concave surfaces of the ribs. This results in even deflection of each wall section until the pair or pairs of lock members 100 are able to pass through the slot of the guide member 28. At this time, the curtain 12 is at least partially disengaged from one or both of the guide members 28, thereby avoiding undue damage to the door components.

It should be noted that the relative position and size of the guide members, the curtain and the lock pairs are such that the lock pairs are normally spaced from each guide member's split socket receptacle when no external force bias is acting on the curtain (as shown in FIG. 3). However, the lock pairs are engaged with the guide member's split socket receptacle when a normal external force bias, such as windloading, is acting on the curtain 12 (as shown in FIGS. 10 and 11). It will be appreciated that each curtain lock pair has a curved exterior which is the inverse of the curved split socket formed by each guide member so that each lock pair can pivot in the described ball joint fashion within its guide member and it can self-adjust to accommodate the dynamic fluctuations in the curtain's position. Moreover, using the described preferred door components, including the guide members and the curtain locks, the door guide and curtain lock combination described herein can be made so that it is reliable and durable and able to provide long door life with long term repeatability of the release of the door edge sections as a result of a predetermined disengagement force. Also, because of the symmetry of the door guides and the curtain lock pairs, the edge sections of the door will reliably disengage from the guide members under a predetermined disengagement force even when there is directional preference of the external force bias.

Figure 19:
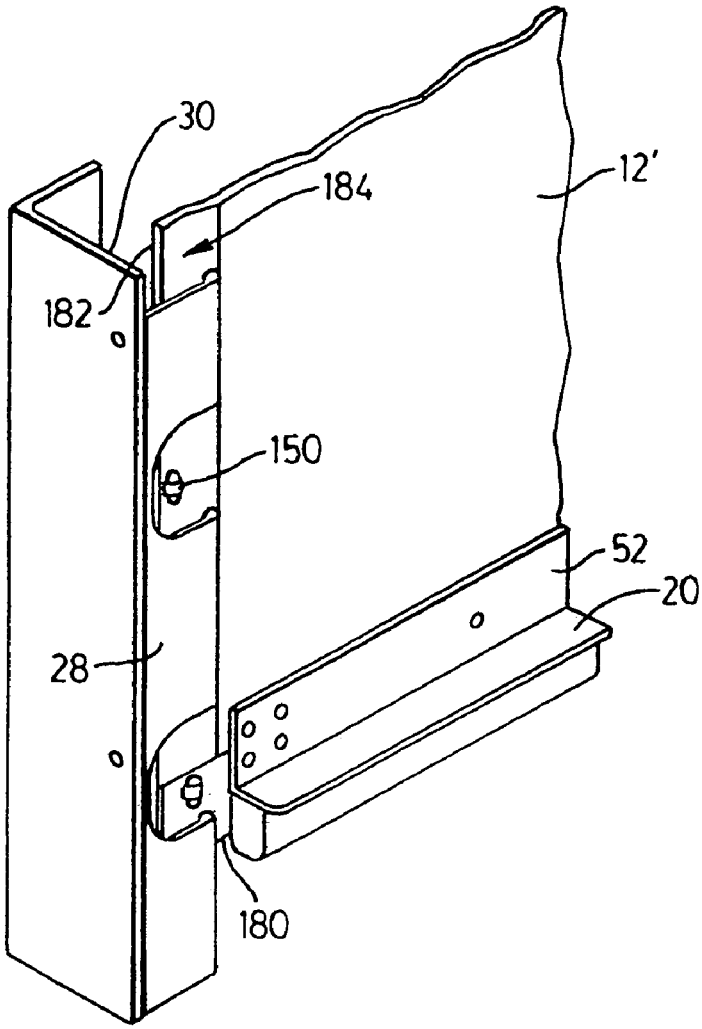
FIG. 19 is an isometric view similar to FIG. 9 but illustrating the use of strips of low friction material affixed to an edge section of the curtain, this figure showing one lower corner of the curtain and a section of one door guide.
Figure 20:
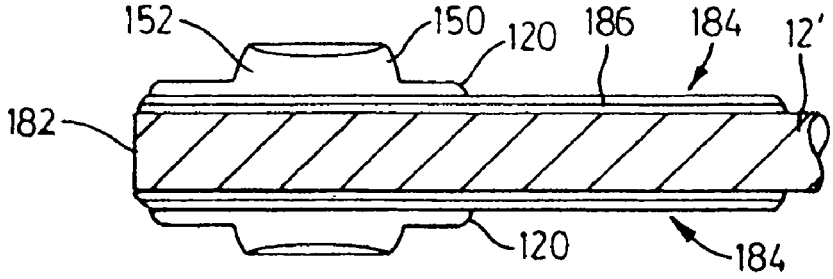
FIG. 20 is a detail cross-sectional view of an edge section of the door curtain shown in FIG. 19.

A variation of the door curtain 12 that comprises a further aspect of the present invention is illustrated in FIGS. 19 and 20. This door curtain can also be made of such flexible materials as rubber, synthetic rubber or fabric and the curtain is of course sized to close a selected doorway. As in the curtain already described above, the curtain 12' has front and rear surfaces, an upper end which is normally attached to a barrel, a lower end indicated at 180 and two opposite side edges. Only one of these side edges 182 is shown in FIGS. 19 and 20. In the curtain 12', strips of low friction, wear-resistant material indicated generally at 184 are applied to at least one of the front and rear surfaces adjacent the opposite side edges of the curtain and are preferably affixed to both the front and rear surfaces as shown in FIG. 20. One wear resistant material that can be used is oliphatic polyetherurethane in dichlormethane (OPD). This wear-resistant material is sold under Product No. NR-7S by Normac Adhesive Products Inc. of Burlington, Ontario, Canada. This material can be applied in two different ways to the edge sections of the curtain 12'. Firstly, a glue strip, preferably comprising the rubber adhesive sold under Product No. XL-2000 is applied to the curtain edge sections where the OPD is to be applied and allowed to dry. Secondly, the OPD is brushed or sprayed on both sides of the curtain edge section over the glue strips and allowed to dry. Alternatively, the OPD strips can be made separately by spraying OPD onto a thin rubber adhesive layer 186 and then after the materials have dried thoroughly, the combined layers are bonded onto each curtain edge section and a rubber adhesive can also be used for this purpose. The preferred rubber adhesive material which forms the base coat 186 is that sold under Product No. XL-2000 by Normac Adhesive Products Inc. Although the combined thickness of the base coat 186 and the OPD can vary, in one preferred embodiment, it is about $1/16^{th}$ inch thick on average with the thickness of the glue layer being only about 0.015 inch thick. XL-2000 adhesive is used to bond the base coat 186 to the adjacent surface of the curtain 12'. Preferably, the strips of wear-resistant material 184 are continuous strips along each edge section and they extend substantially the entire length of the curtain 12'.

An alternative wear resistant material that can be used for the strips 184 is polyethyleneterepthalate (PET) polyester with a polyvinylchloride (PVC) backing. This material is available from Sampla Belting Canada Ltd. in Milton, Ontario, Canada and is sold under product number XX3AS. This material can be bonded to the curtain edges with a rubber adhesive in the same manner as the above described prefabricated OPD strips.

As can be seen from FIGS. 19 and 20, the spaced apart pairs of curtain lock members 150 are mounted on and distributed along the side edge sections of the curtain 12' and these lock members 150 are positioned on and applied to the strips of material 184. It will be appreciated that the advantages obtained with the low friction, wear-resistant strips 184 include reducing the amount of friction between the side edge sections of the curtain and the door guides (and thus-the amount of power required to operate the roll-up curtain) and reducing the amount of wear and tear on both the curtain edge sections and on the guides themselves.

Figure 21:
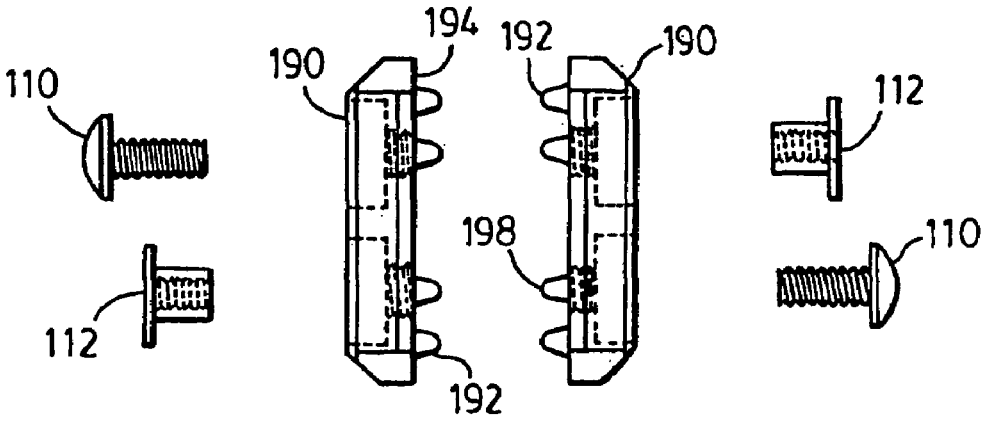
FIG. 21 is a side detail view showing two preferred forms of lock members in position for attachment and illustrating the fasteners to be used.
Figure 22:
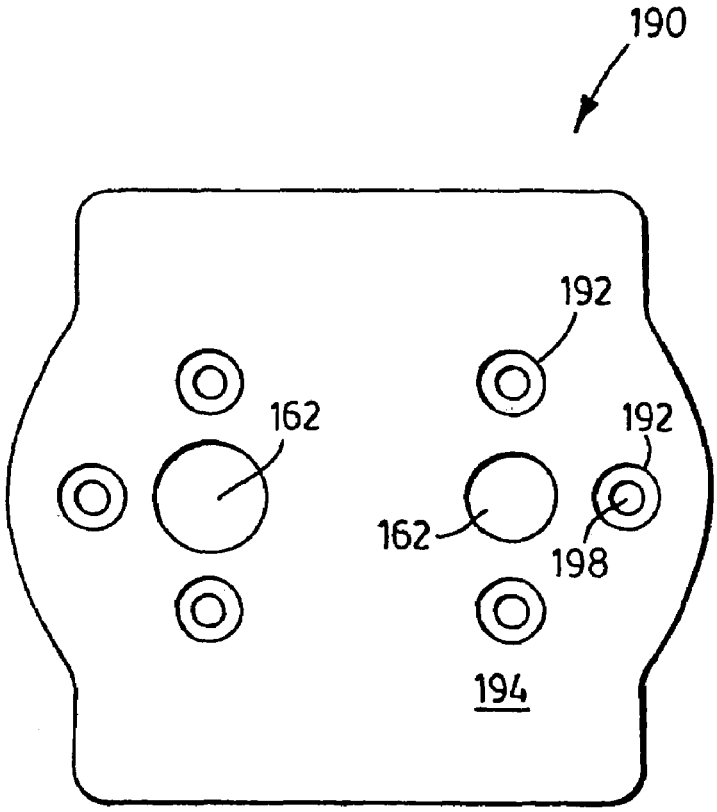
FIG. 22 is a bottom view of one of the preferred lock members shown in FIG. 21.

A preferred form of lock member 190 is illustrated in FIGS. 21 and 22. This lock member 190 is substantially the same as the lock member 150 illustrated in FIGS. 15 to 17 except for the addition of six tapered pins 192. These six pins are visible in FIG. 22 which shows the bottom surface 194 of the lock member. The pins 192, which are relatively short, are adapted to project into the adjacent side edge section of the door curtain in order to assist in holding the curtain lock member in place on the curtain during use of the door assembly. The pins are distributed over the bottom surface 194 with three pins being located around one of the holes 162 and another three pins located around the other hole 162. It will be appreciated that the pins 192 assist the mechanical fasteners ie. the machine screws 110, in preventing of the shearing of the curtain locks from the curtain during use of the door curtain, for example, when it is struck by a vehicle. In one preferred embodiment, each pin 192 measures about 0.144 inch in diameter at its base and tapers down to 0.072 inch in diameter at its end 198. This preferred pin has a height of 0.10 inch. It will be appreciated that when the curtain is made of a flexible material such as rubber or synthetic rubber, the pins can press into the flexible material and form their own indentation to provide a good grip between the bottom surface of the lock member and the curtain.

From the above description of preferred embodiments, it will be seen that the present invention provides a curtain and door guide combination which is an improvement over prior art roll-up door constructions. The described, preferred curtain construction and door guides are able to cooperate in a "ball joint" fashion so that they can dynamically self-adjust at rest or during motion and evenly distribute the external force between the inner and outer wall sections of each guide member.

The described roll-up type door remains functional and free moving with minimal frictional effect even during normal external force bias to the curtain such as windloading.

In the preferred roll-up door construction described herein, pairs of curtain locks can be provided along each vertical edge of the curtain so that there is plenty of contact area between the lock members and each guide member to facilitate force dissipation, thereby reducing wear.

It will be readily apparent to those skilled in the construction and operation of roll-up type doors that various modifications and changes can be made to the described and illustrated roll-up type door, door guides and curtain locks without departing from the spirit and scope of this invention. Accordingly, all such variations and modifications as fall within the scope of the appended claims are intended to be part of this invention.

The invention claimed is:

1. A roll-up door assembly comprising:

a flexible curtain made of rubber, synthetic rubber or fabric material and capable of closing a doorway, said curtain having upper and lower ends, two opposite side edges, a length, and a width;

a curtain winding mechanism having said upper end of said curtain attached thereto for raising said curtain by rolling said curtain up;

two straight, extruded flexible guide members which are mounted so as to extend vertically on opposite, vertical sides of said doorway during use of said door assembly, two side edge sections of said curtain each being movable in a respective one of said guide members when said curtain is raised or lowered during use thereof;

each guide member formed with two wall sections comprising integrally connected, inner and outer, longitudinally extending, resilient wall sections, each wall section having an integral, inwardly projecting, longitudinally extending rib, the two ribs of each guide member forming an elongate slot which has a width and through which a respective one of said side edge sections can extend during use of the door assembly, each rib forming a longitudinally extending concave surface which is concave as seen in a transverse cross-section of the respective guide member, the two concave surfaces of the two ribs of each guide member forming an elongate split socket arrangement; and pairs of curtain lock members mounted on and distributed along each side edge section of said curtain with each pair of the curtain lock members on its respective side edge section being spaced apart from adjacent pairs on the same side edge section, the lock members of each pair being positioned directly opposite one another on front and rear surfaces of said curtain respectively, a combined thickness of each pair of said lock members and said curtain material exceeding the width of said elongate slot so that the pairs of lock members prevent said side edge sections of the curtain from escaping out of the guide members under normal windload or pressure conditions, said split socket arrangement engaging pairs of said lock members located in their respective guide member during use of said door assembly, wherein at least some curtain lock members engage with the ribs of their respective guide members when an excessive windload or impact is put upon the curtain and this engagement causes the wall sections of at least one guide member to separate from each other and thereby release the respective side edge section from the at least one guide member with little if any damage to the curtain or the guide members.

2. A roll-up door assembly according to claim 1 including strips of material affixed to both of said front and rear surfaces of said curtain adjacent said opposite side edges, said wear resistant material selected from a group of materials consisting of oliphatic polyetherurethane in dichlormethane (OPD), and polyethylene terepthalate polyester (PET) with a polyvinylchloride backing.

3. A roll-up door assembly according to claim 1 including a rigid bottom bar mounted on said lower end of the curtain and having opposite ends which are located within the doorway and horizontally inwards from the guide members during use of the door assembly, wherein at least one pair of said lock members is mounted on each side edge section of the curtain at a location horizontally outwardly from a respective adjacent end of the bottom bar when said door assembly is in use.

4. A roll-up door assembly according to claim 1 wherein each curtain lock member is made of plastics material, has an elongate main body section having a rounded exterior surface as seen from an end of the respective lock member, and is mounted on its side edge section of the curtain so that its longitudinal axis is substantially parallel to the adjacent side edge of the curtain.

5. A roll-up door assembly according to claim 4 wherein each guide member has a base which is integrally connected to and joins the inner and outer wall sections of the guide member and said base has a plurality of threaded fastener holes formed therein and longitudinally spaced along the guide member, and wherein said door assembly includes threaded fasteners for mounting said guide members on support surfaces, said threaded fasteners in use extending into and engaging said threaded fastener holes.

6. A roll-up door assembly according to claim 4 wherein each curtain lock member has two opposite end sections which are tapered and has two counter-bored screw holes for mounting the lock member to the curtain by means of screws.

7. A roll-up door assembly according to claim 4 wherein each curtain lock member has a bottom provided with a plurality of short pins that project into the adjacent side edge section of the curtain in order to assist in holding the curtain lock member in place on the curtain during use of the door assembly.

8. A roll-up door assembly comprising:

a flexible curtain made of rubber, synthetic rubber or fabric material and capable of closing a doorway, said curtain having upper and lower ends and two opposite side edges;

a curtain winding mechanism having said upper end of said curtain attached thereto for raising said curtain by rolling said curtain up;

two straight, extruded flexible guide members which are mounted so as to extend vertically on opposite, vertical sides of said doorway during use of said door assembly, two side edge sections of said curtain each being movable in a respective one of said guide members when said curtain is raised or lowered during use thereof;

each guide member formed with two wall sections comprising integrally connected, inner and outer, longitudinally extending, resilient wall sections, each wall section having an inwardly projecting, longitudinally extending rib, the two ribs of each guide member forming an elongate slot which has a width and through which a respective one of said side edge sections can extend during use of the door assembly; and spaced-apart pairs of curtain lock members mounted on and distributed along each side edge section of said curtain, the lock members of each pair being positioned opposite one another on front and rear surfaces of said curtain respectively, a combined thickness of each pair of said lock members and said curtain material exceeding the width of said elongate slot so that the pairs of lock members prevent said side edge sections of the curtain from escaping out of the guide members under normal windload or pressure conditions, each curtain lock member being made of a low-friction, wear resistant, plastics material, having an elongate main body section with a rounded exterior surface as seen from an end of the respective lock member, and being mounted on its side edge section of the curtain so that its longitudinal axis is substantially parallel to the adjacent side edge section of the curtain, each curtain lock member having a substantially flat wing section integrally connected to one side of said main body section and adapted to extend outwardly through said slot during use of said door assembly;

wherein at least some curtain lock members engage with the ribs of their respective guide members when an excessive windload or impact is put upon the curtain and this engagement causes the wall sections of at least one guide member to separate from each other and thereby release the respective side edge section from the at least one guide member with little if any damage to the curtain or the guide members.

9. A roll-up door assembly according to claim 1 wherein each guide member comprises a single elongate hollow member made of metal which is sufficiently flexible and resilient that pairs of the curtain lock members can be pulled out of their respective guide members by excessive windload or an impact with little, if any, damage to the guide member.

10. A roll-up door assembly according to claim 8 wherein the two wing sections of a pair of the lock members and the curtain material have a combined thickness that is less than the width of said elongate slot.

11. A roll-up door assembly comprising:

a flexible curtain made of rubber, synthetic rubber or fabric material and capable of closing a doorway, said curtain having upper and lower ends and two opposite side edges;

a curtain winding mechanism having said upper end of said curtain attached thereto for raising said curtain by rolling said curtain up;

two straight, extruded flexible guide members which are mounted so as to extend vertically on opposite, vertical sides of said doorway during use of said door assembly, two side edge sections of said curtain each being movable in a respective one of said guide members when said curtain is raised or lowered during use thereof;

each guide member formed with two wall sections comprising integrally connected, inner and outer, longitudinally extending, resilient wall sections, each wall section having an inwardly projecting, longitudinally extending rib, the two ribs of each guide member forming an elongate slot which has a width and through which a respective one of said side edge sections can extend during use of the door assembly; and spaced-apart pairs of curtain lock members mounted on and distributed along each side edge section of said curtain, the lock members of each pair being positioned opposite one another on front and rear surfaces of said curtain respectively, a combined thickness of each pair of said lock members and said curtain material exceeding the width of said elongate slot so that the pairs of lock members prevent said side edge sections of the curtain from escaping out of the guide members under normal windload or pressure conditions, each curtain lock member being formed with at least two screw holes, the lock members of each pair being mounted on their respective side edge section and being connected to each other by at least two screws that extend through or into the screw holes of their respective lock members, wherein at least some curtain lock members engage with the ribs of their respective guide members when an excessive windload or impact is put upon the curtain and this engagement causes the wall sections of at least one guide member to separate from each other and thereby release the respective side edge section from the at least one guide member with little if any damage to the curtain or the guide members.

12. A door curtain lock for retaining an edge section of a flexible door curtain in an elongate door guide mounted on a side of a doorway, said lock comprising a lock member made of a low friction, wear resistant plastics material, said lock member having an elongate, rigid main body section having an exterior surface which is rounded as viewed from one end of the lock member, said rounded exterior surface extending to at least one longitudinal side of the main body section, said lock member also having an inner surface adapted for mounting to a front or rear surface of said door curtain and a substantially flat wing section integrally connected to one longitudinal side of the main body section and adapted to extend into an elongate slot formed in said door guide during use of said curtain lock, wherein said wing section projects outwardly from an inner edge of the main body section and wherein at least one hole for a mechanical fastener is formed in said main body section.

13. A door curtain lock according to claim 12 wherein there are two holes for mechanical fasteners formed in said main body section and said two holes are countersunk in order to accommodate heads of the mechanical fasteners.

14. A door curtain lock according to claim 12 wherein said lock member has two opposite end sections which taper longitudinally outwardly and in the direction of the inner surface of the lock member.

15. A door curtain lock according to claim 12 wherein said lock member is made of copolymer polyacetal resin.

16. A door curtain lock according to claim 12 wherein a plurality of short pins are provided on and distributed over said inner surface, said pins assisting in holding the curtain lock in place on said door curtain during use of the door curtain.

17. A door curtain lock for retaining an edge section of a flexible door curtain in an elongate door guide mounted on a side of a doorway, said lock comprising a lock member made of a low friction, wear resistant plastics material, said lock member having an elongate, rigid main body section having an exterior surface which is rounded as viewed from one end of the lock member, said rounded exterior surface extending to at least one longitudinal side of the main body section, said lock member also having an inner surface adopted for mounting to a front or rear surface of said door curtain, wherein two substantially flat wing sections extend outwardly from the two longitudinal sides of the main body section, at least one of said wing sections being adapted to extend into an elongate slot formed in said door guide during use of the curtain lock, both wing sections projecting from respective inner edges of the main body section, wherein at least one hole for a mechanical fastener is formed in said main body section.

* * * * *